US007617612B2

(12) United States Patent
Brizendine

(10) Patent No.: US 7,617,612 B2
(45) Date of Patent: Nov. 17, 2009

(54) TRUSS SUPPORT AND SPACING APPARATUS

(76) Inventor: Craig Brizendine, 1125 Glen Hinson Rd., Centerville, TN (US) 37033

( * ) Notice: Subject to any disclaimer, the term of this patent is extended or adjusted under 35 U.S.C. 154(b) by 0 days.

(21) Appl. No.: 12/327,789

(22) Filed: Dec. 3, 2008

(65) Prior Publication Data

US 2009/0139184 A1 Jun. 4, 2009

Related U.S. Application Data

(60) Provisional application No. 60/992,253, filed on Dec. 4, 2007, provisional application No. 61/014,750, filed on Dec. 19, 2007, provisional application No. 61/016,810, filed on Dec. 27, 2007.

(51) Int. Cl.
*G01D 21/00* (2006.01)
*E01D 15/00* (2006.01)

(52) U.S. Cl. ..... 33/613; 33/645; 52/749.12

(58) Field of Classification Search ..... 33/613, 33/645; 52/203, 639–644, 690–697, 749.12
See application file for complete search history.

(56) References Cited

U.S. PATENT DOCUMENTS

| | | | | |
|---|---|---|---|---|
| 2,686,959 | A * | 8/1954 | Robinson | 33/613 |
| 3,959,945 | A | 6/1976 | Allen | |
| 4,322,064 | A * | 3/1982 | Jarvis | 33/613 |
| 4,604,845 | A | 8/1986 | Brinker | |
| 4,790,113 | A * | 12/1988 | Gregory | 52/646 |
| 5,412,920 | A | 5/1995 | Hess | |
| 5,884,448 | A | 3/1999 | Pellock | |
| 6,244,010 | B1 | 6/2001 | Sluiter | |
| 6,332,299 | B1 | 12/2001 | Stewart, III | |
| 6,354,055 | B1 | 3/2002 | Shaw et al. | |
| 6,393,794 | B1 | 5/2002 | Pellock | |
| 6,993,882 | B2 | 2/2006 | Crawford et al. | |
| 7,152,338 | B2 | 12/2006 | Thompson et al. | |
| 7,213,377 | B1 | 5/2007 | Sackett | |
| D587,099 | S * | 2/2009 | Brizendine | D8/354 |
| 2002/0092259 | A1 * | 7/2002 | Crawford et al. | 52/696 |

* cited by examiner

*Primary Examiner*—Yaritza Guadalupe-McCall
(74) *Attorney, Agent, or Firm*—Christopher Wood; Wood & Eisenberg, PLLC

(57) ABSTRACT

A kit for laterally spacing and supporting a plurality of roof trusses, comprising at least one spacer bar for laterally spacing roof trusses and at least one truss support stand.

1 Claim, 14 Drawing Sheets

TRUSS SUPPORT AND SPACING APPARATUS

CROSS-REFERENCE TO RELATED APPLICATIONS

This application claims the benefit of priority from U.S. Provisional Patent Application Ser. Nos. 60/992,253 (filed Dec. 4, 2007), 61/014,750 (filed Dec. 19, 2007) and 61/016,810 (filed Dec. 27, 2007). The entire contents of 60/992,253 (filed Dec. 4, 2007), 61/014,750 (filed Dec. 19, 2007) and 61/016,810 (filed Dec. 27, 2007) are herein incorporated by reference in their entirety.

STATEMENT REGARDING FEDERALLY SPONSORED RESEARCH OR DEVELOPMENT

Not Applicable.

FIELD OF THE INVENTION

This invention relates generally to assisting construction workers erect trusses.

BACKGROUND OF THE INVENTION

As noted in U.S. Pat. No. 6,244,010, structural trusses are used for the fabrication of buildings in the construction industry. A truss is typically made up of upper and lower chords with web angled members therebetween to create an essentially planar structure. When added to a building structure, trusses of metal or wooden construction are typically set in a parallel spaced apart relationship. There are various types of trusses such as, but not limited to, roof trusses that are set up in a parallel spaced apart relationship and depending on the type of roof truss, are used to support flat or non-flat roofs of buildings.

Setting up trusses is both a dangerous and time consuming task. The trusses must be set up a certain distance apart in a parallel arrangement. Given the planar like construction of trusses and their tendency to fall over it is not surprising that setting up roof trusses is time consuming and poses accident hazards for construction workers.

There is therefore a continuing need for devices and ways to enable construction workers to safely support and space out trusses.

SUMMARY

A kit for laterally spacing and supporting a plurality of roof trusses, comprising at least one spacer bar for laterally spacing roof trusses and at least one truss support stand.

DETAILED DESCRIPTION OF THE INVENTION

This invention is directed to a truss assembly kit comprising at least one spacer bar and at least one truss support stand for spacing out and providing temporary support to trusses such as light weight trusses or wooden trusses. The spacer bar and truss support stand of the present invention are denoted generally by the numeric labels "100" and "1000", respectively.

Figure 2:
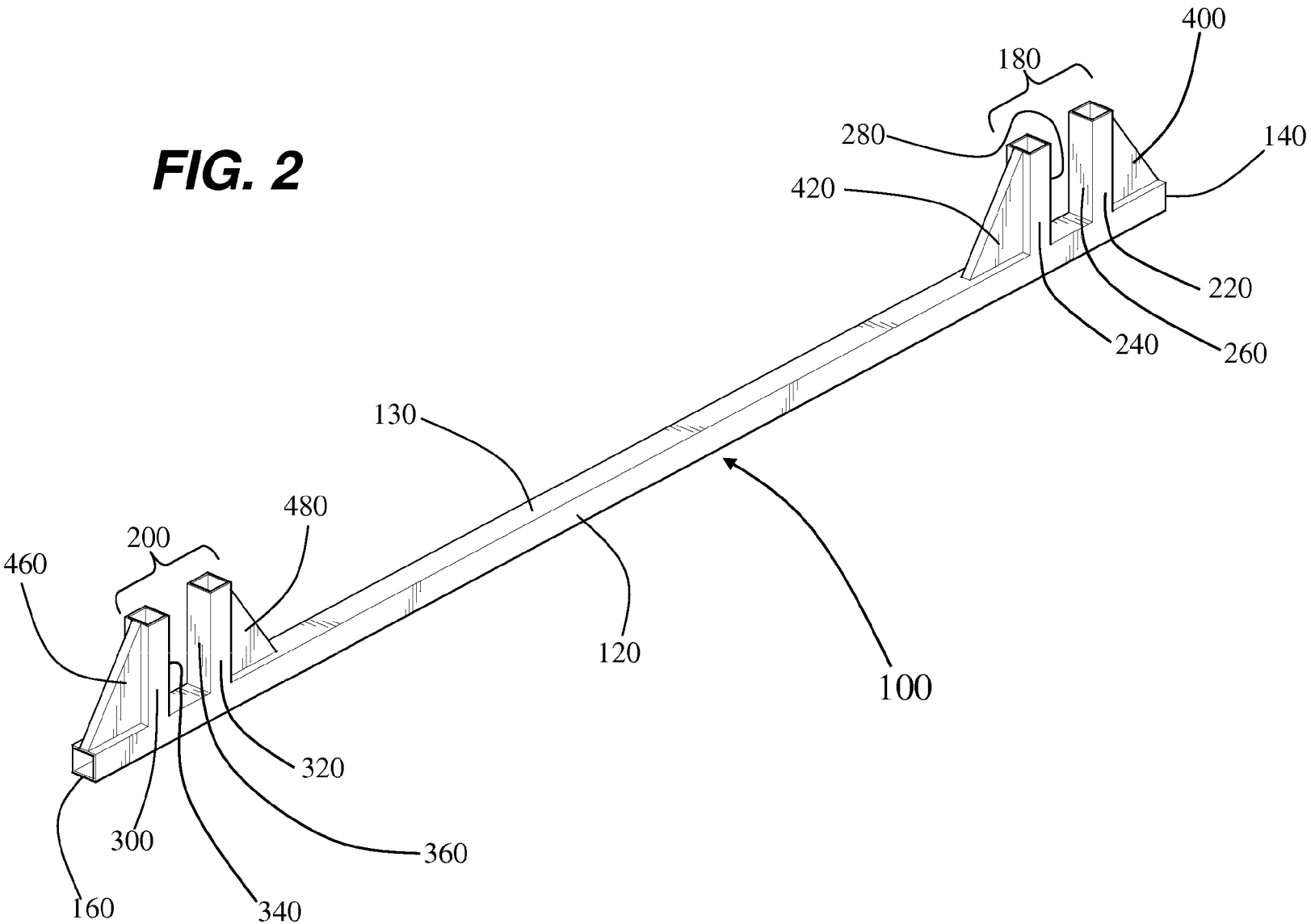
FIG. 2 shows a perspective bottom view of the spacer bar shown in FIG. 1.
Figure 3:
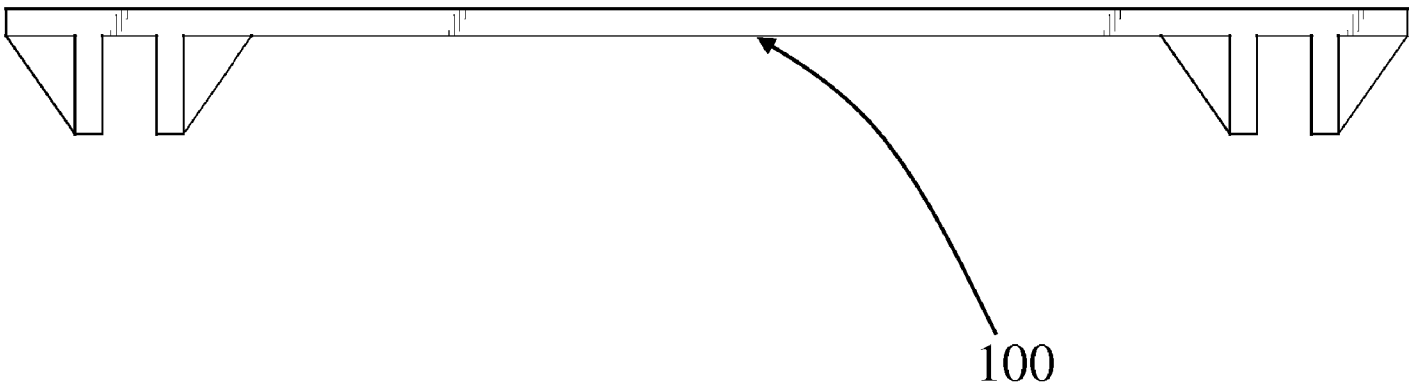
FIGS. 3 and 4 respectively show side and end-on views of the spacer bar shown in FIG. 1.
Figure 4:
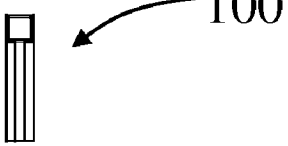
Figure 5:
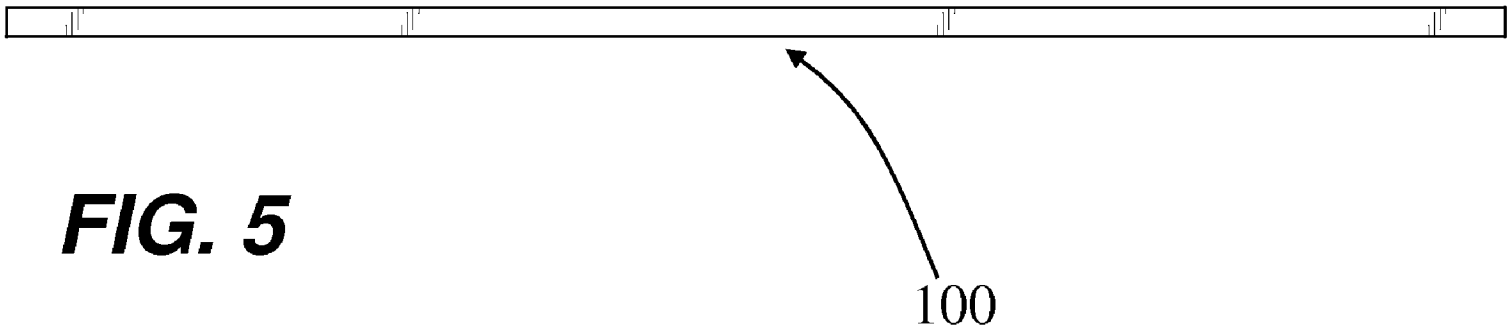
FIGS. 5 and 6 respectively show top and bottom planar views of the spacer bar shown in FIG. 1.
Figure 6:
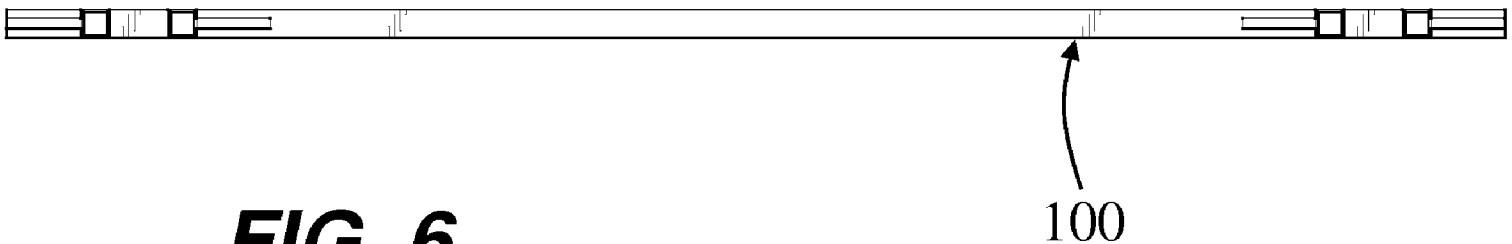

With respect to FIGS. 1 through 7, the terms "upper," "lower," "right," "left," "rear," "front," "vertical," "horizontal," and derivatives thereof shall relate to the spacer bar 100 as oriented in FIG. 3.

Figure 8:
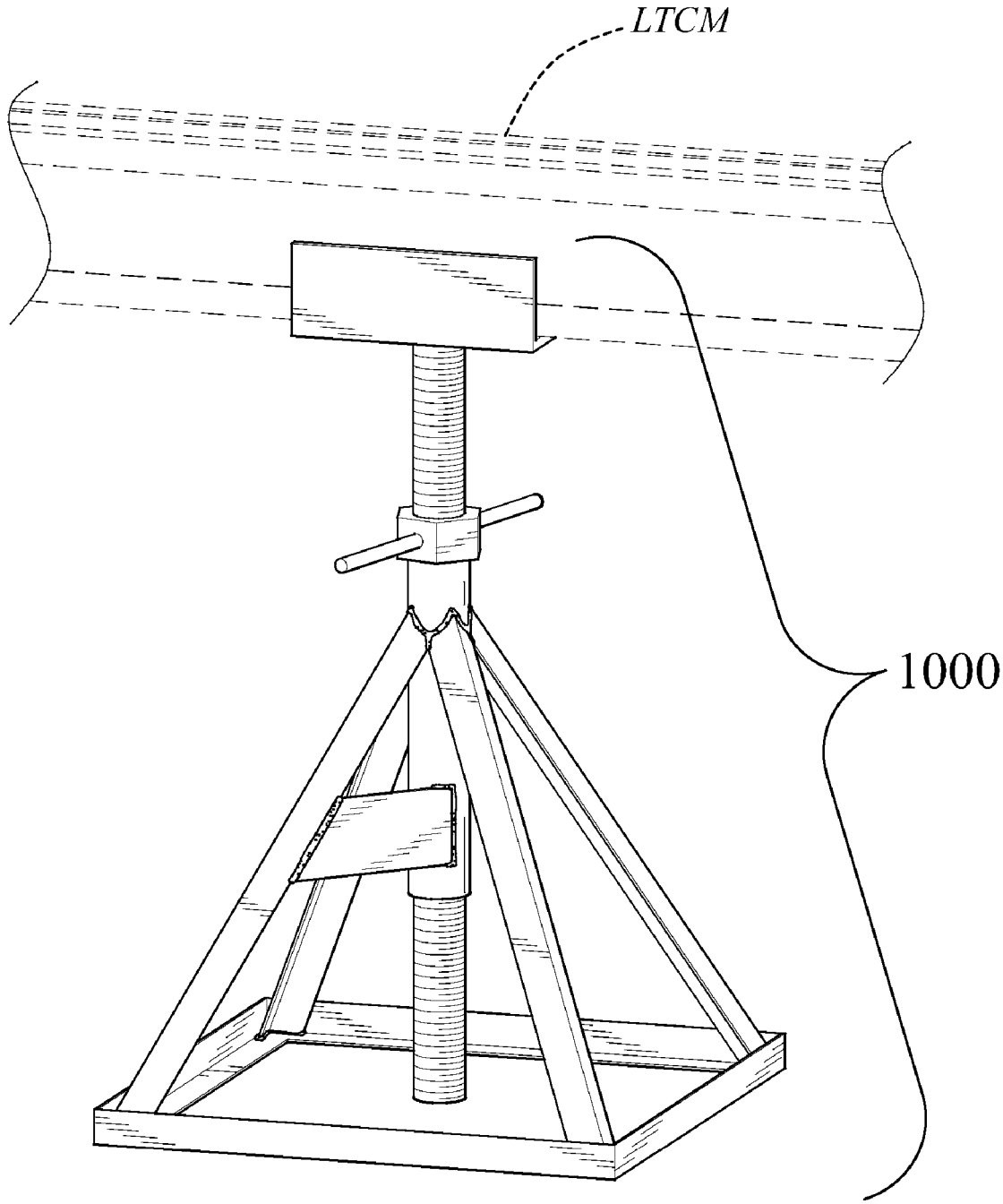
FIG. 8 shows an environmental view of a truss support stand according to the present invention.
Figure 9:
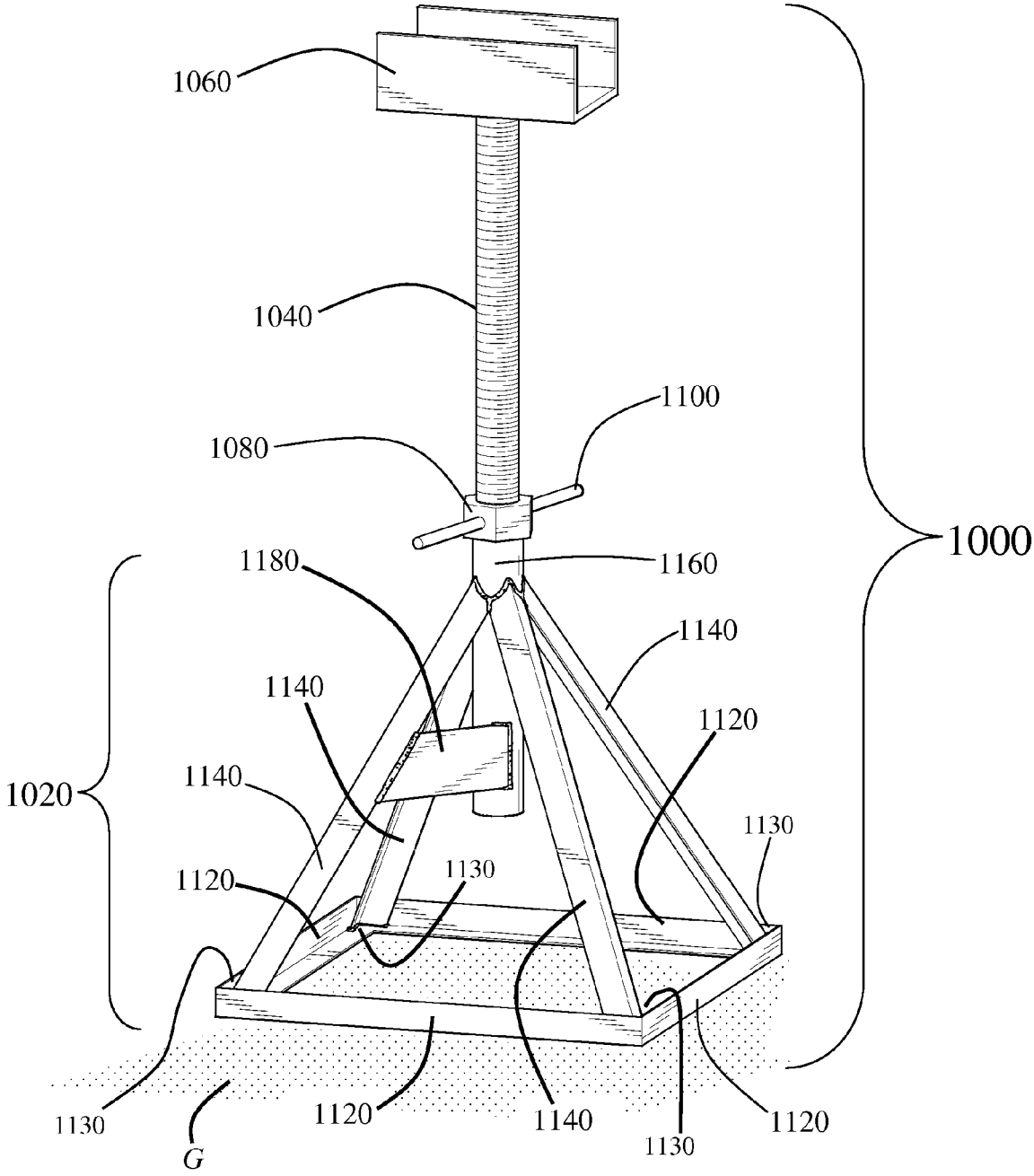
FIG. 9 shows a perspective view of the truss support stand of FIG. 8.
Figure 10:
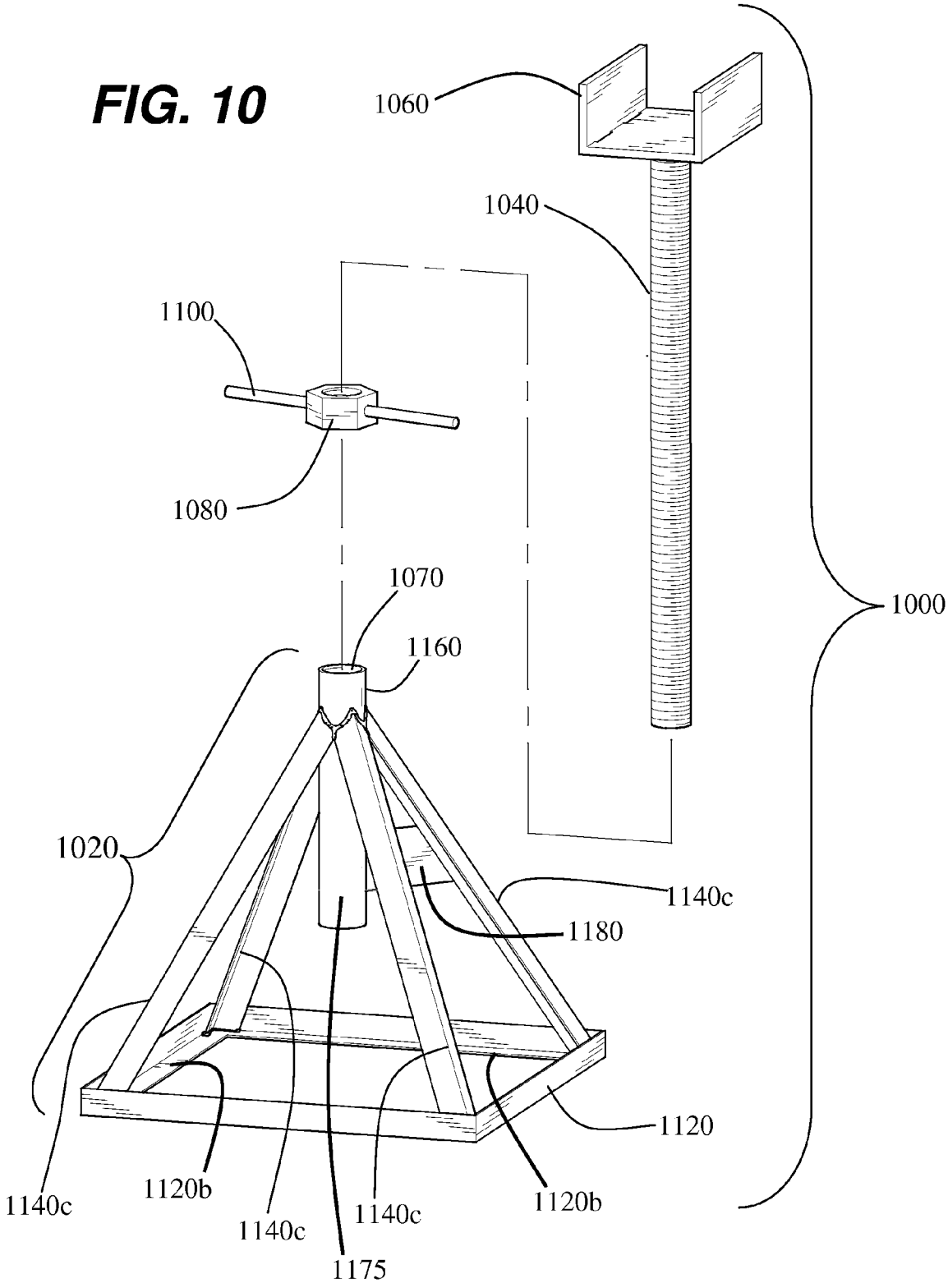
FIG. 10 shows an exploded view of the truss support stand shown in FIG. 8.
Figure 11:
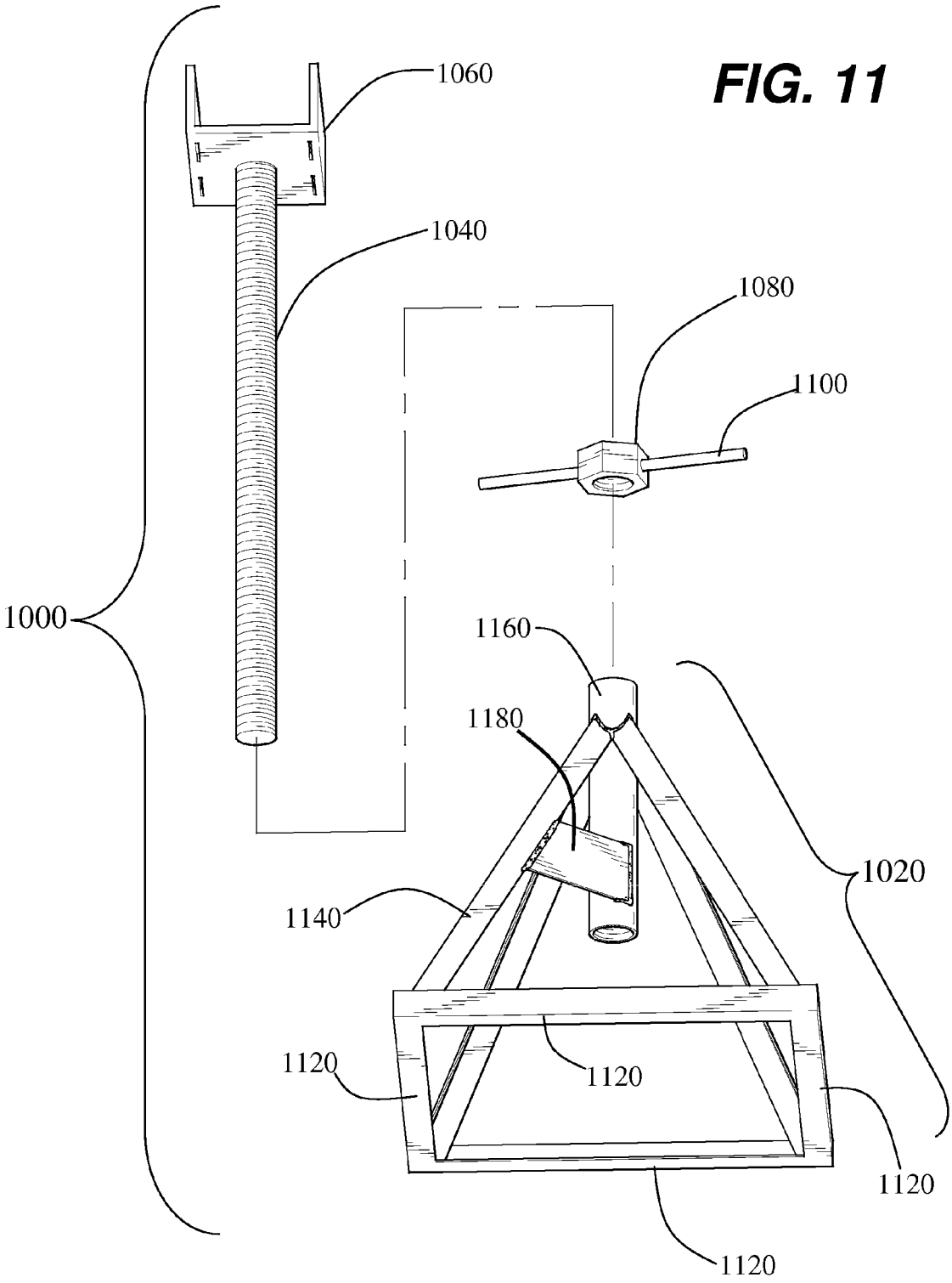
FIG. 11 shows a further exploded view of the truss support stand shown in FIG. 8.
Figure 12:
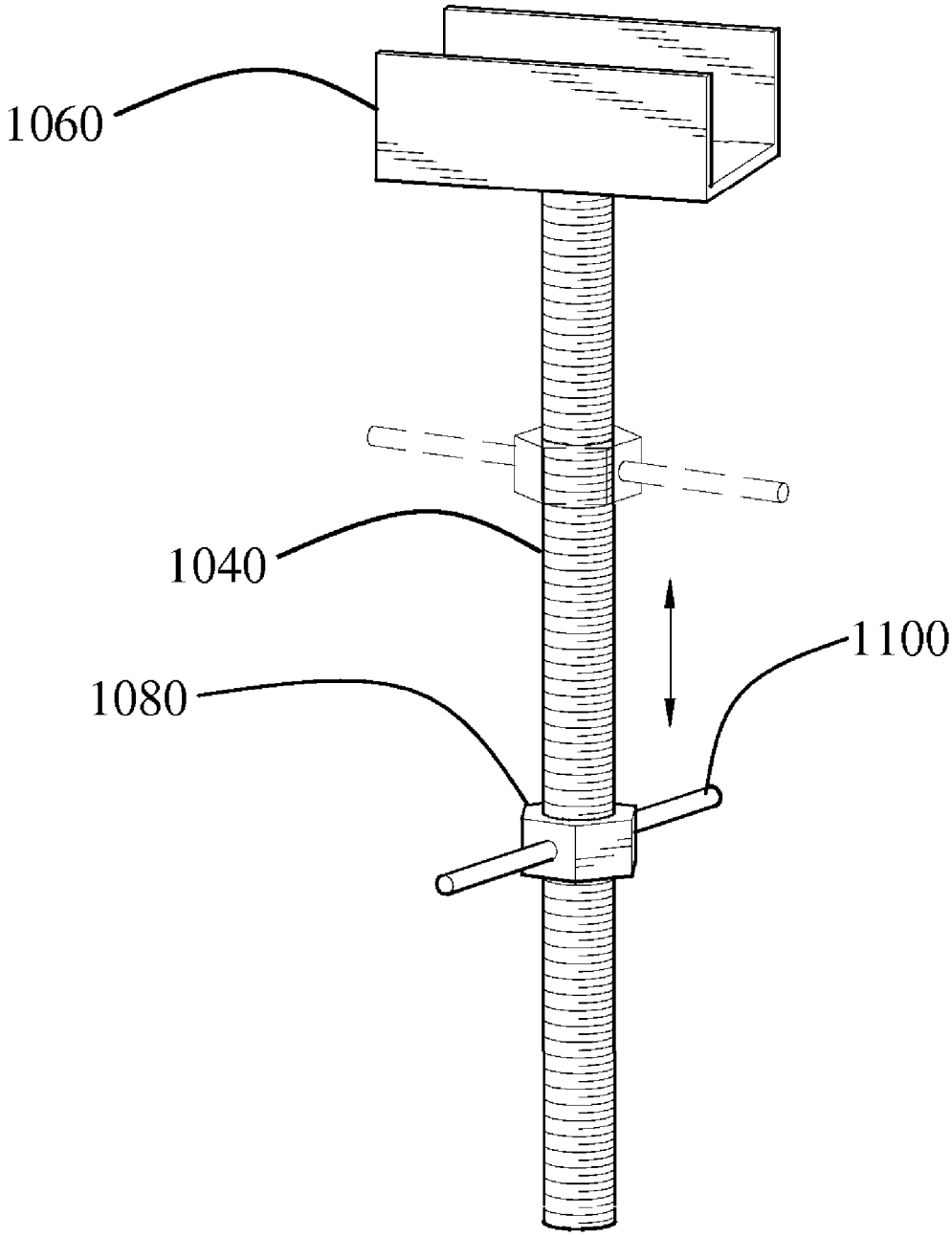
FIG. 12 shows an upper part of the truss support stand shown in FIG. 8.

With respect to FIGS. 8 through 12, the terms "upper," "lower," "right," "left," "rear," "front," "vertical," "horizontal," and derivatives thereof shall relate to the truss support stand 1000 as oriented in FIG. 9.

With respect to FIGS. 1 through 7 and FIG. 13, the spacer bar 100 comprises an elongated tube 120 having a square or rectangular cross-section and further comprising a bottom surface 130. The elongated tube 120 defines first and second opposite ends 140 and 160, respectively. Located proximate to the first and second opposite ends 140 and 160 are first and second rectangular jaws 180 and 200, which extend at a normal angle from the bottom surface 130. First and second rectangular jaws 180 and 200 are designed to reversibly accommodate the profile of a corresponding chord members CM or interior truss web members ITWM or lower truss chord member LTCM of adjacent trusses T (see FIG. 7). The term "reversibly accommodate" is intended to mean that the jaws 180 and 200 can be affixed to and removed from chord members CM or interior truss web members ITWM of adjacent trusses T or lower truss chord member LTCM thus enabling spacer bar 100 to be used repeatedly as temporary bracing for temporarily bracing together strings of adjacent trusses such as light weight trusses, e.g., used in the construction of roofs.

First jaw 180 comprises first and second rigid arms 220 and 240, respectively. The first and second rigid arms 220 and 240 are fixed to and extend at a normal angle from bottom surface 130 of elongated tube 120. The rigid arms 220 and 240 respectfully define first and second interior confronting surfaces 260 and 280. The interior confronting surfaces 260 and 280 are parallel with respect to each other and are positioned normal to the longitudinal axis LA of elongated tube 120. The interior confronting surfaces 260 and 280 of arms 220 and 240 are spaced a sufficient distance apart just enough to accommodate the thickness of a truss chord or truss angled web member.

Second jaw 200 comprises third and fourth rigid arms 300 and 320, respectively. The third and fourth rigid arms 300 and 320 are fixed to and extend at a normal angle from bottom surface 130 of elongated tube 120. The rigid arms 300 and 320 respectfully define third and fourth interior confronting surfaces 340 and 360. The interior confronting surfaces 340 and 360 are parallel with respect to each other and are positioned normal to the longitudinal axis LA of elongated tube 120. The interior confronting surfaces 340 and 360 of arms 300 and 320 are spaced a sufficient distance apart just enough to accommodate the thickness of a truss chord or truss angled web member.

The distance between first and second jaws 180 and 200 is sufficient to span the desired distance between two adjacent chord members CM or two adjacent internal truss web members ITWM. More specifically, the distance between first and second jaws 180 and 200 is chosen to suit the desired spacing between trusses such as light weight trusses. For example, one, two, three or four feet or any desired metric distance used in foreign (non-U.S.) countries for spacing out trusses such as light-weight roof trusses.

Figure 1:
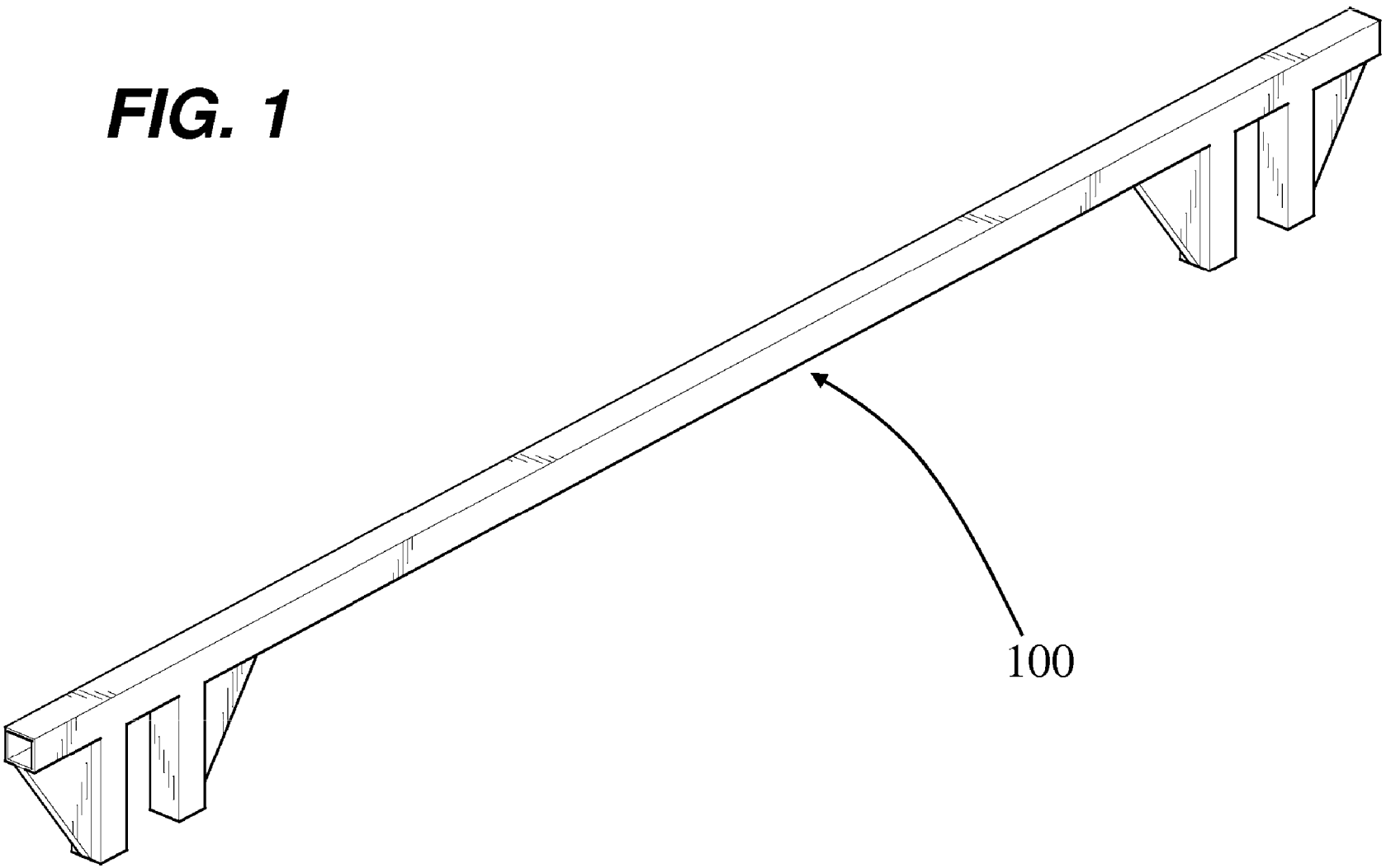
FIG. 1 shows a perspective top view of a spacer bar according to the present invention.
Figure 1A:
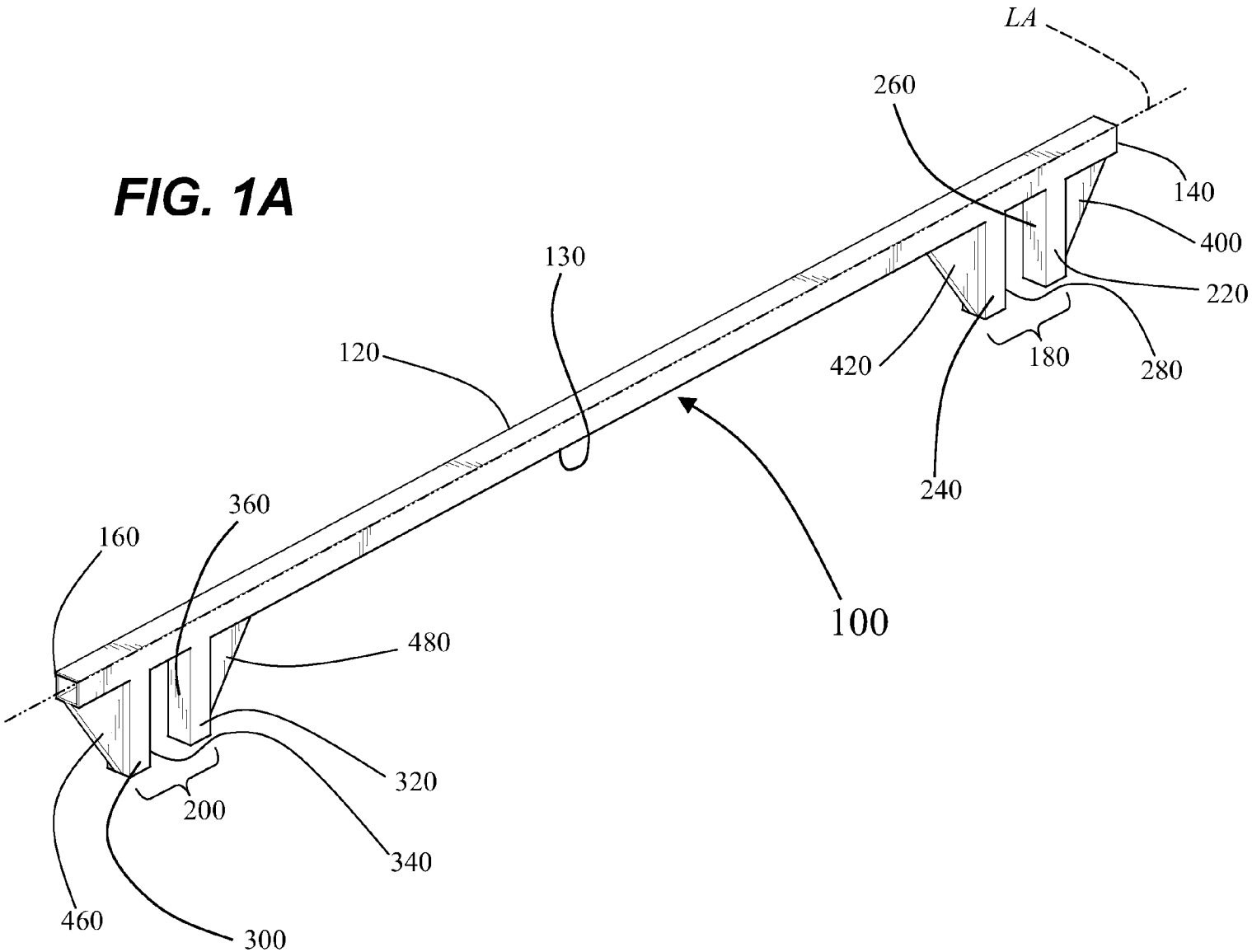
FIG. 1A shows the spacer bar shown in FIG. 1.
Figure 1B:
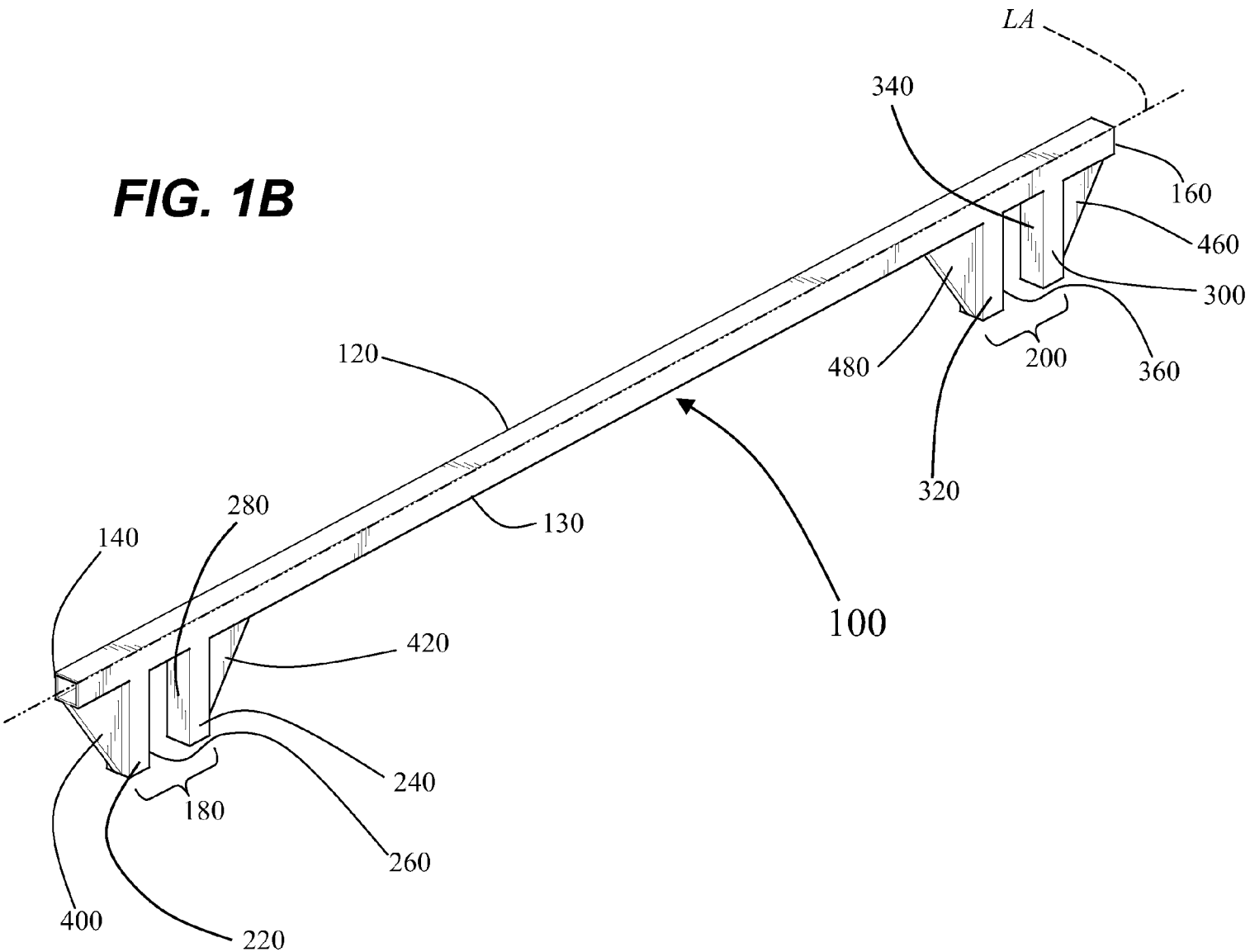
FIG. 1B shows the spacer bar shown in FIG. 1A, but rotated 180° in the horizontal plane.

Generally planar triangular shaped reinforcing members extend from bottom surface 130 and are affixed to and located either side of jaws 180 and 200 as shown, for example, in FIG. 2. First 400 and second 420 generally planar triangular shaped reinforcing members are located on either side of jaw 180, whereas third 460 and forth 480 generally planar triangular shaped reinforcing members are located on either side of jaw 200 (see FIGS. 1A and 2).

Figure 1C:
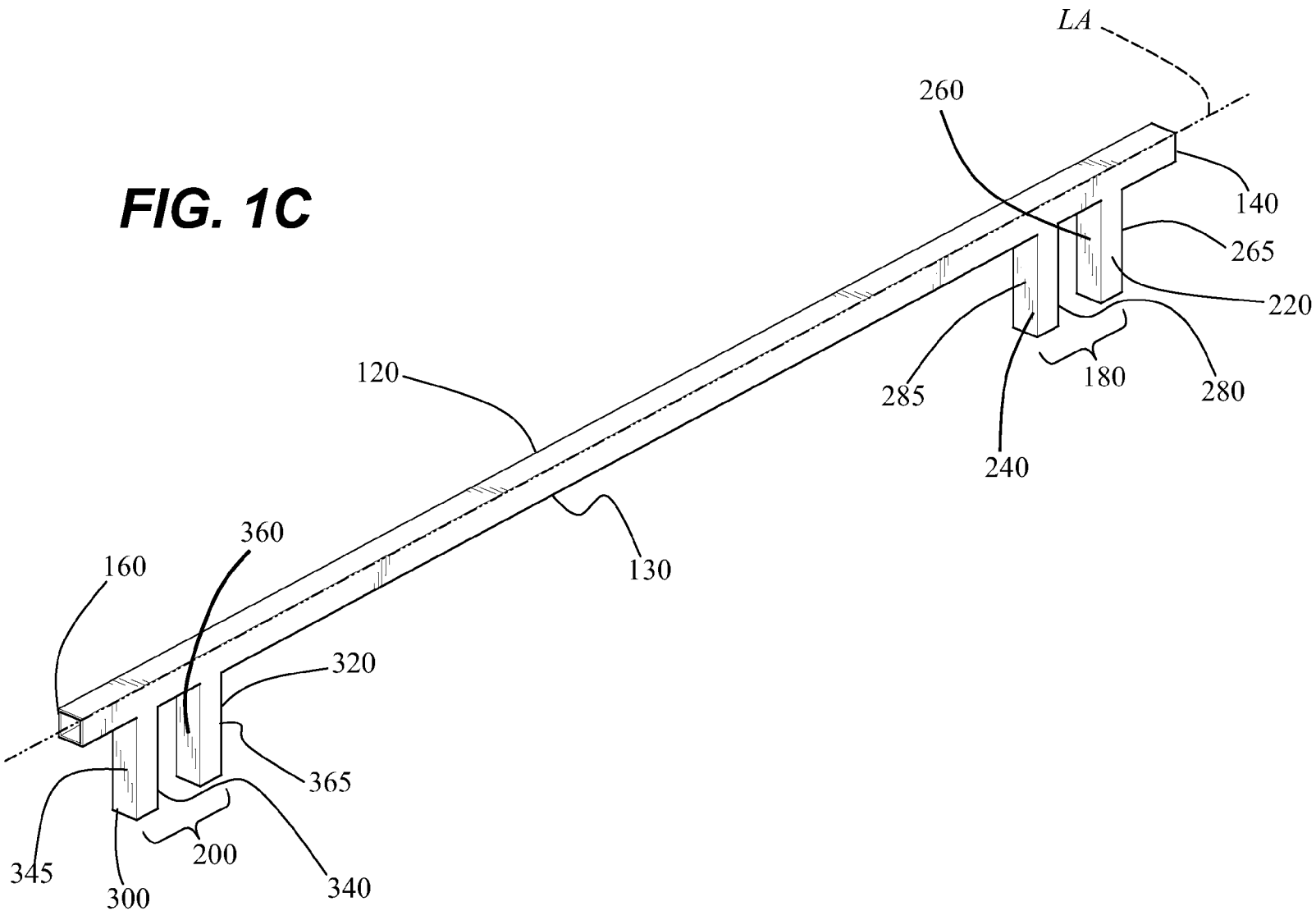
FIG. 1C shows a spacer bar with triangular shaped reinforcing members removed.

More specifically, first 400 and second 420 generally planar triangular shaped reinforcing members respectively extend between bottom surface 130 and first and second outward facing surfaces 265 and 285 of first and second rigid arms 220 and 240. The first and second outward facing surfaces 265 and 285 are respectively opposite and facing away from first and second interior confronting surfaces 260 and 280 (see FIG. 1C in which reinforcing members 400, 420, 460 and 480 have been removed to illustrate surfaces 265, 285, 345 and 365).

Third 460 and fourth 480 generally planar triangular shaped reinforcing members respectively extend between bottom surface 130 and third and fourth outward facing surfaces 345 and 365 of third and fourth rigid arms 300 and 320, respectively. The third and fourth outward facing surfaces 345 and 365 are respectively opposite and facing away from third and fourth interior confronting surfaces 340 and 360 (see FIG. 1C in which reinforcing members 400, 420, 460 and 480 have been removed to illustrate surfaces 265, 285, 345 and 365).

The triangular shaped reinforcing members 400, 420, 460, 480 provide the dual purpose of stiffening elongated tube 120 while ensuring that the first and second jaws 180 and 200 resist distortion under load, and more specifically that the arms of the first and second jaws 180 and 200 resist distortion under load.

Figure 7:
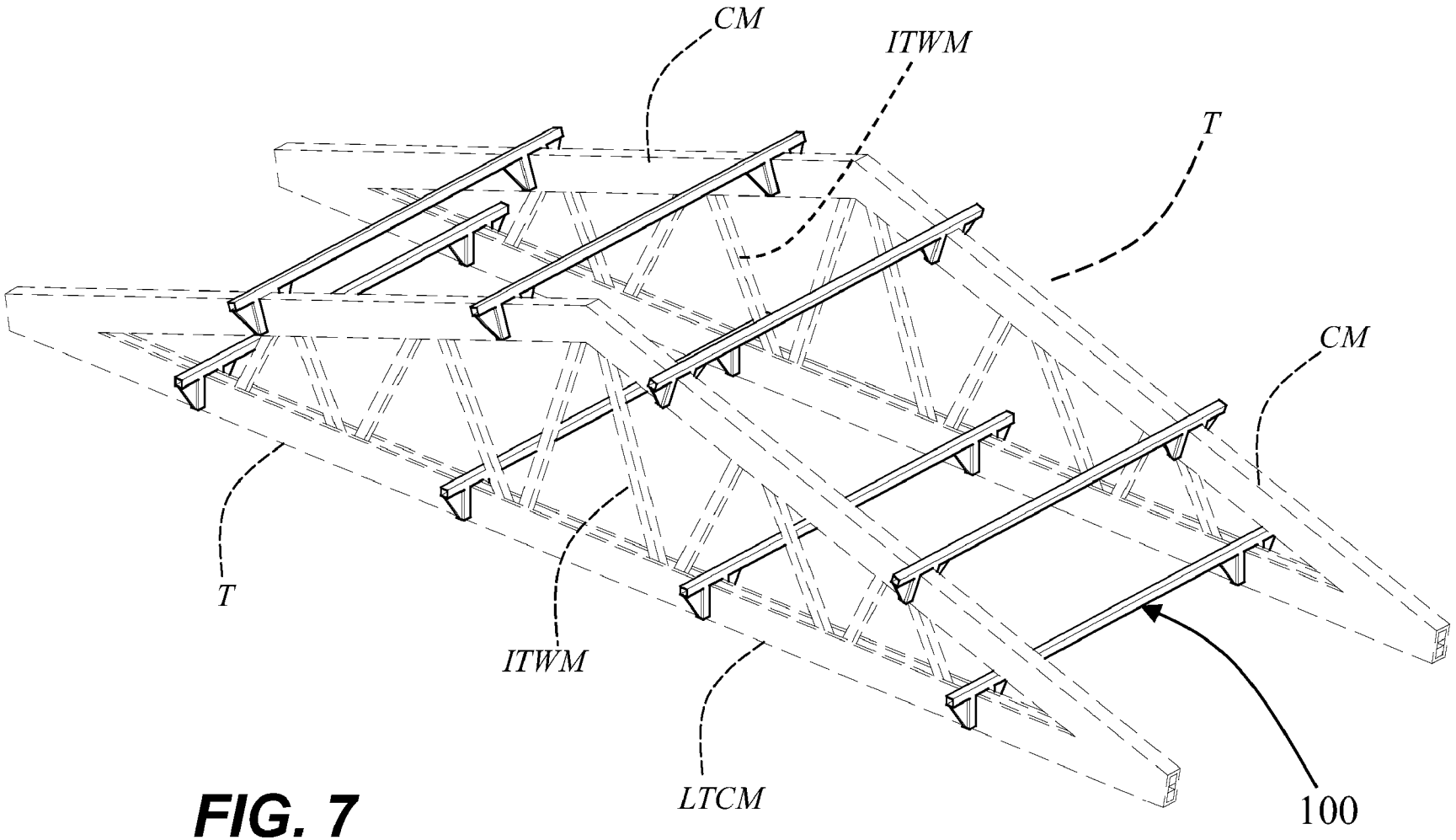
FIG. 7 shows an environmental perspective view of a plurality of spacer bars of the present invention.
Figure 13:
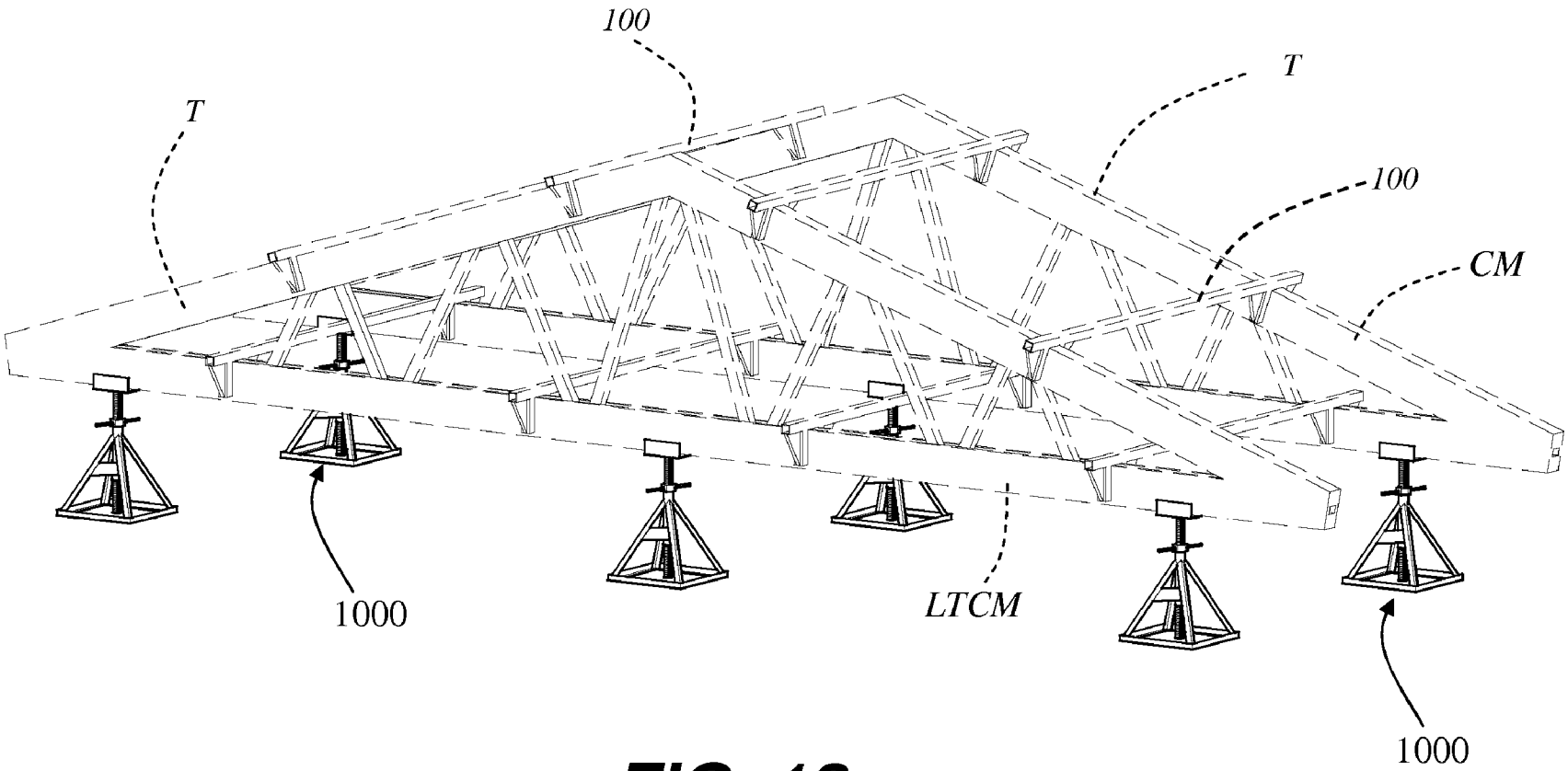
FIG. 13 shows an environmental view of at least one truss support stand used in combination with at least one spacer bar to respectively support and space apart adjacent roof trusses.

During ordinary use, the spacer bar 100 is tapped or otherwise installed onto chord members CM or interior truss web members ITWM of adjacent trusses; see FIGS. 7 and 13, which show a plurality of spacer bars connected between chord members of adjacent trusses T. The spacer bars of the present invention are typically tapped off when no longer required. Light taps from a hammer or similar hand-held tool can be used to tap the spacer bar jaws on and off trusses. A plurality of spacer bars can be supplied and sold as a cross-bracing kit for laterally spacing roof trusses.

In normal use the jaws 180 and 200 are typically tapped onto corresponding chords CM or interior truss web members ITWM of adjacent trusses. In this fashion strings of adjacent trusses are correctly spaced out and maintained in their correct vertical positions. Permanent bracing can then be applied between the trusses and the spacer bars 100 removed; once removed the spacer bars 100 can be used repeatedly on further truss construction projects.

With particular reference to FIGS. 8 through 13, the truss support stand 1000 comprises a base 1020. The base 1020 supports a threaded rod 1040 atop which sits a truss support member 1060. The base 1020 supports the rod 1040 through a threaded nut 1080. During normal operation of the truss support stand 1000, the threaded nut 1080 rests on the top portion of base 1020. The threaded nut 1080 threadably engages threaded rod 1040. The threaded nut 1080 can be rotated by a handle to raise or lower the truss support member 1060 (see FIG. 12). In FIG. 9, the handle is represented by cross-handle 1100.

The truss support member 1060 has a rectangular U-shaped cross-section and is open at both ends to provide unimpeded support to a truss such as a lower truss chord member LTCM of a truss as depicted in FIG. 8 (also see FIG. 13). Adjacent lightweight trusses can be supported by placing truss support stands 1000 at appropriate positions under adjacent light weight trusses as depicted in FIG. 13. More specifically, FIG. 13 shows an environmental view of a plurality of truss support stands 1000 used in combination with a plurality of spacer bars 100 to respectively support and correctly space apart adjacent light weight trusses.

The base 1020 comprises a plurality of bottom horizontal side members 1120 and a plurality of legs 1140. The plurality of legs 1140 extend upwardly and inwardly from the bottom horizontal side members 1120 and are connected at their upper ends to a vertical tube 1160. The base 1020 shown in FIG. 9 has a pyramid configuration with a square or rectangular ground plan, i.e., the horizontal side members 1120 collectively define a four sided regular polygonal shape in the form of a square or rectangle, which during ordinary use rests directly on the ground G. During ordinary use each of the horizontal side members 1120 rest against the ground G (see FIG. 9).

In FIG. 9 the legs 1140 define four triangular shaped open sides projected upwards and inwards with a common vertex, i.e., the upper parts of each leg are joined to the exterior of the vertical tube 1160. Each leg 1140 is an elongated right-angle bar with an L-shaped cross-section; each leg 1140 defines a corner edge 1140*c* (see FIG. 10).

It should be understood, however, that the bottom horizontal side members 1120 can define any suitable polygonal ground plan such as a triangular (i.e., three sided) ground plan in which case the legs 1140 would define three triangular shaped open sides projected upwards and inwards with a common vertex, i.e., the upper parts of each leg are joined to the exterior of the vertical tube 1160.

The vertical tube 1160 has a hollow bore 1170, is open at both ends, defines an exterior surface 1175, and is sized to accommodate the shaft of rod 1040. At least one tube stabilizing member 1180 extends between at least one of the legs 1140 and the exterior surface 1175 of vertical tube 1160. For example, in FIG. 9 a single stabilizing member 1180 is shown extending between the upper part of one of the legs 1140 and the exterior surface 1175 of the lower part of tube 1160.

The load resulting from a truss chord resting on truss support member 1060 is instantly transferred from truss support member 1060 to the ground via threaded rod 1040 thence via threaded nut 1080 thence via vertical tube 1160, then via legs 1140 to horizontal side members 1120 and thence to the ground G.

The horizontal side members 1120 are preferably elongated metal sections of equal length having an L-shaped cross-section, e.g., cut-lengths of L-shaped iron or steel bar as shown, for example, in FIG. 9. The horizontal side members 1120 are attached at their ends to form corners 1130; any suitable method, such as welding, can be used to join the ends of horizontal side members 1120. Horizontal side members 1120 define internal corners 1130 (four of which are shown in FIG. 9) into which legs 1140 can be directly welded in place. More specifically, the corner edge 1140*c* of each leg 1140 is aligned in a corner-to-corner relationship with a corresponding corner 1130. This form of construction provides a relatively cheap way of manufacturing the base 1020 compared to the more complicated and more costly base described in the Brammer patent (U.S. Pat. No. 3,493,209, issued Feb. 3, 1967).

The legs 1140 are preferably made of elongated metal sections having an L-shaped cross-sections, e.g., cut-lengths of L-shaped iron or steel bar such as 2"×2"×¼" (2 inches by 2 inches by 0.25 inches thickness).

The remaining parts of the truss support stand 1000 (e.g., the at least one stabilizing member 1180, rod 1040, nut 1080, handle 1100, and truss support member 1060) can be made from steel or any suitable metal or alloy.

In one embodiment of the invention a kit is provided for laterally spacing and supporting a plurality of roof trusses, comprising at least one spacer bar 100 and at least one truss support stand 1000 with regard to which FIG. 13 shows an environmental view of the kit in actual use.

The invention being thus described, it will be evident that the same may be varied in many ways by a routineer in the applicable arts. Such variations are not to be regarded as a departure from the spirit and scope of the invention and all such modifications are intended to be included within the scope of the claims.

I claim:

1. A kit for laterally spacing and supporting a plurality of roof trusses, comprising:

at least one spacer bar for laterally spacing roof trusses, comprising:

first and second rectangular jaws respectively disposed proximate to said first and second opposite ends, said first and second rectangular jaws extend at a normal angle from said bottom surface, said first rectangular jaw comprises first and second rigid arms, said second rectangular jaw comprises third and fourth rigid arms, and first, second, third and fourth planar triangular shaped reinforcing members, said first and second planar triangular reinforcing members respectively extend between said first and second rigid arms and said bottom surface of said elongated tube, and said third and fourth planar triangular reinforcing members respectively extend between said third and fourth rigid arms and said bottom surface of said elongated tube; and at least one truss support stand, comprising:

a vertical tube of hollow bore and opposite top and bottom open ends, said vertical tube has an exterior surface;

a base, said base comprises a plurality of bottom horizontal side members and a plurality of legs, said plurality of legs extend upwardly and inwardly from said bottom horizontal side members to connect with the exterior surface of said vertical tube;

a stabilizing member, said stabilizing member extends between the exterior surface of said vertical tube and the upper part of one of said plurality of legs;

a threaded rod, said threaded rod having opposite top and bottom ends, wherein said threaded rod extends into said bore of said vertical tube;

a truss support member having open opposite ends and a rectangular U-shaped cross-section, wherein the truss support member is attached to the top end of said threaded rod;

a threaded nut, said threaded nut threadably engages said threaded rod, said threaded nut is sized to sit atop of said vertical tube thereby supporting said threaded rod inside said vertical tube; and a handle attached to said threaded nut, wherein said handle enables an operator to adjust the height of said threaded tube and thereby the height of said truss support member in relation to said vertical tube.

* * * * *